United States Patent [19]

Forde

[11] Patent Number: 4,996,810

[45] Date of Patent: Mar. 5, 1991

[54] ACCESS FLOORING

[76] Inventor: Philip J. Forde, 16 Green Lane, Heaton Moor, Stockport, England

[21] Appl. No.: 87,215

[22] Filed: Aug. 20, 1987

[30] Foreign Application Priority Data

Oct. 7, 1986 [GB] United Kingdom ..... 8624069

[51] Int. Cl.[5] ..... E04B 5/48

[52] U.S. Cl. ..... 52/221; 52/403; 52/477; 52/480; 52/607

[58] Field of Search ..... 52/220, 221, 403, 607, 52/608, 126.5, 126.6, 477, 263, 603, 480; 174/48; 404/37, 38, 34, 46

[56] References Cited

U.S. PATENT DOCUMENTS

| | | | |
|---|---|---|---|
| 3,663,347 | 5/1972 | Schoen | 52/DIG. 10 X |
| 3,852,928 | 12/1974 | Raith | 52/263 |
| 3,938,295 | 2/1976 | Tate | 52/263 X |
| 3,984,621 | 10/1976 | Propst | 174/48 |
| 3,995,434 | 12/1976 | Kato et al. | 61/4 |
| 4,016,357 | 4/1977 | Abrahamsen | 52/263 X |
| 4,085,557 | 4/1978 | Tharp | 52/263 |
| 4,449,342 | 5/1984 | Abendroth | 52/480 X |
| 4,637,184 | 1/1987 | Radtke et al. | 52/220 |
| 4,682,453 | 7/1987 | Holmgren | 52/126.2 |
| 4,683,690 | 8/1987 | Röollin et al. | 52/126.2 |
| 4,773,196 | 9/1988 | Yoshida et al. | 52/126.5 X |

FOREIGN PATENT DOCUMENTS

| | | | |
|---|---|---|---|
| 0115475 | 4/1987 | European Pat. Off. . | |
| 2147039 | 3/1973 | Fed. Rep. of Germany | 52/221 |
| 2204969 | 8/1973 | Fed. Rep. of Germany | 52/220 |
| 2351551 | 4/1975 | Fed. Rep. of Germany | 52/403 |
| 2432273 | 1/1976 | Fed. Rep. of Germany | 52/220 |
| 2608852 | 8/1977 | Fed. Rep. of Germany . | |
| 2725950 | 12/1978 | Fed. Rep. of Germany | 52/220 |
| 2823236 | 11/1979 | Fed. Rep. of Germany | 52/220 |
| 2823236 | 11/1979 | Fed. Rep. of Germany | 52/220 |
| 3041624 | 9/1982 | Fed. Rep. of Germany . | |
| 7404993 | 11/1974 | Netherlands | 52/403 |
| 275707 | 8/1927 | United Kingdom . | |
| 909131 | 10/1962 | United Kingdom | 52/220 |
| 1067504 | 5/1967 | United Kingdom . | |
| 1178949 | 1/1970 | United Kingdom . | |

OTHER PUBLICATIONS

Wheeler et al., "Modular Raised Floor", Nov. 1969, IBM Technical Disclosure Bulletin, vol. 12, No. 6, one page.

*Primary Examiner*—David A. Scherbel
*Assistant Examiner*—Lan Mai
*Attorney, Agent, or Firm*—Oblon, Spivak, McClelland, Maier & Neustadt

[57] ABSTRACT

There is disclosed a slab (10) adapted to be laid on a floor surface (11) in abutting relationship with like slabs to form an access floor. The slab has at least one channel (20) on its underside extending between edges thereof and adapted to be coincident with the channels of neighboring slabs to form an extended duct through which cabling and the like may be extended.

3 Claims, 2 Drawing Sheets

ACCESS FLOORING

BACKGROUND OF THE INVENTION

1. Field of the Invention:

This invention concerns access flooring and more particularly slabs for the construction of same.

2. Discussion of the Background:

Providing services such as power, telephone data transmission lines and so on at workstations in open plan office accommodation has presented many problems. The services must be taken either from the ceiling or the floor. If ports to them are sited at permanent positions, for example during construction of the building, rearrangement of the workstations in the accommodation is difficult, if not impossible, and one of the principal benefits of the open plan concept is lost.

Providing services from the ceiling tends to be unsightly, even when costly service columns are used, and for this reason provision of services from the floor is more generally favoured.

Many kinds of access floor are known wherein the floor is formed from a multiplicity of mutually abutting panels, selected ones of which may be lifted to gain access to an underfloor space through which cables can be run at will or through duct systems incorporated in the floor substrate. These systems are very costly requiring complex supporting means for the panels capable of adjustment for levelling purposes, panels of substance, and well carpetted to lower drumming noise from traffic over the hollow floor to acceptable levels. Generally these kinds of access floor cannot be installed in an old building, the resulting loss of height between floor and ceiling being unacceptable and requiring refitting of all internal doors. When specified for a new building an underfloor space of 45 cm or so is normal and the height and cubic capacity of a multi-story building are dramatically increased, as of course is its cost.

It is an object of the present invention to provide an access flooring system which is inexpensive, capable of installation in either new or old buildings, and which generally overcomes at least to some extent problems associated with previous systems.

SUMMARY OF THE INVENTION

According to the present invention there is provided a slab adapted to be laid on a floor surface in abutting relationship with like slabs to form an access floor, the slab having at least one channel on its undersurface extending between edges thereof, the channels of adjacent slabs being coincident to form extended ducts.

The slabs may be of square, rectangular, hexagonal or other shape enabling their abutment to form a continuous and extended surface.

There may be two channels crossing at an angle, preferably a right angle, on the underside of each slab.

The corners between channels where they intersect may be rounded, as also may the corners where the channels exit the edges of the slab.

The channels may be defined by lands secured to the underside of an upper panel, the lands and panel together forming the slab.

A layer of resiliently compressible material may be incorprated between the lands and the panel.

The panel and lands may be cut from a wood chipboard.

The upper surface of the slab may be covered with a carpet tile.

The invention will be further apparent from the following description with reference to the several figures of the accompanying drawings which show, by way of example only, an access floor constructed from one form of slab embodying the invention.

Of the drawings:

DETAILED DISCLOSURE OF THE PREFERRED EMBODIMENTS

Figure 1:
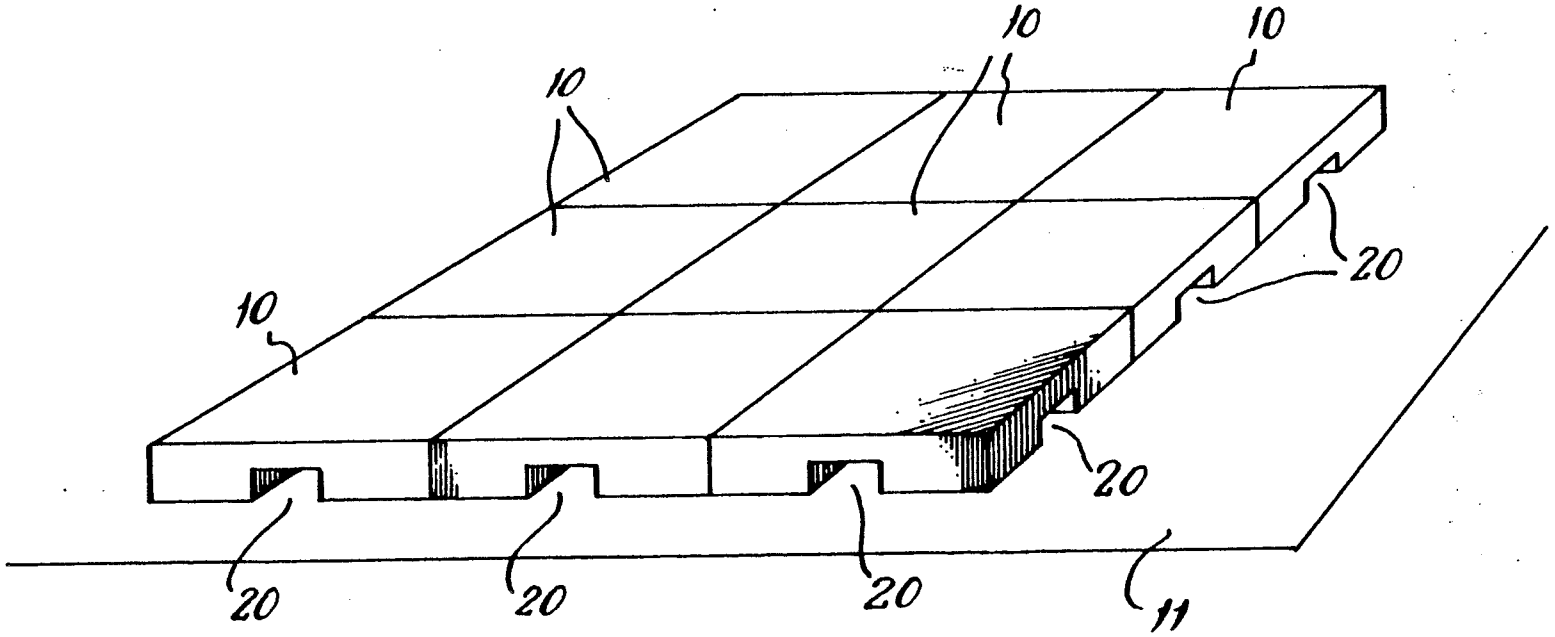
FIG. 1 shows a perspective view of a section of the access floor.
Figure 2:
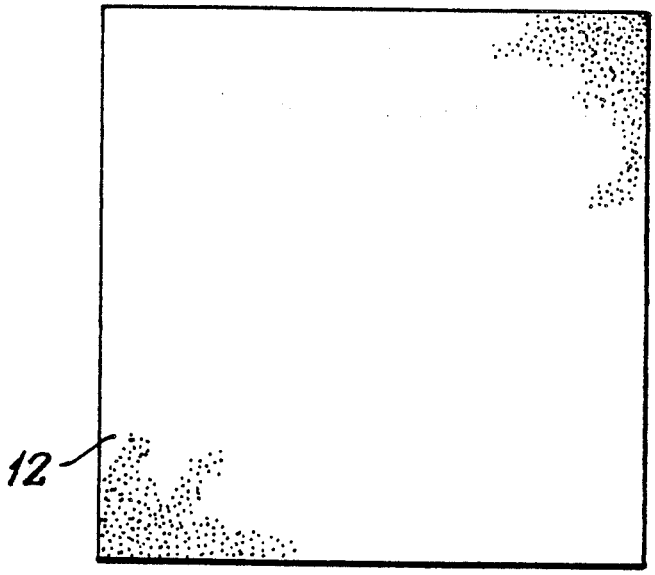
FIG. 2 shows a top plan view of one of the slabs from which the access floor of FIG. 1 is formed.
Figure 3:
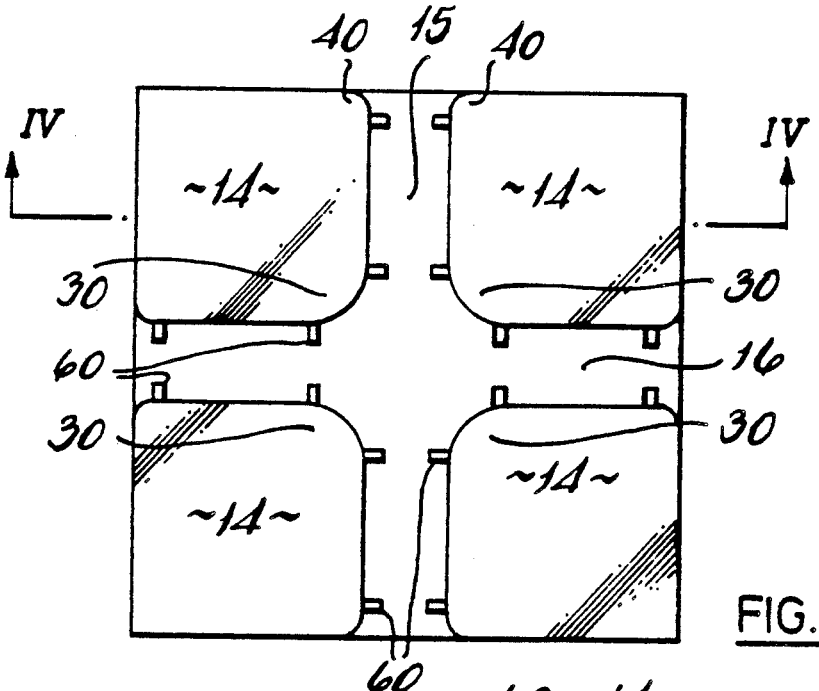
FIG. 3 shows an underneath plan view of the slab of FIG. 2.
Figure 4:
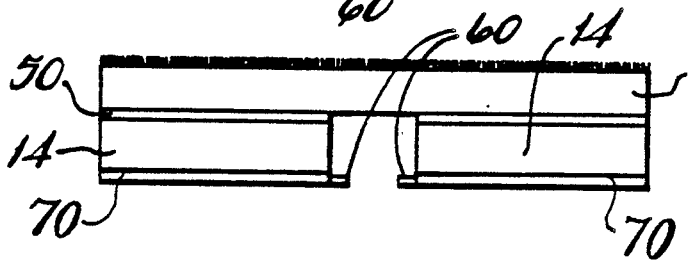
FIG. 4 shows a cross-section through the slab on the line IV—IV of FIG. 3.

Referring now to the drawings it will be seen that the access floor is constructed from a multiplicity of slabs 10 which are laid in mutually abutting relationship on a floor substrate 11 to form a continuous and extended floor surface. In this example the slabs are of square shape having sides of 50 cm in length.

The substrate may be comprised by a concrete screed, mastic asphalt, an already carpetted floor or any permanent load-bearing substantially level surface.

Each slab 10 is constructed from a square top panel 12 cut from a sheet of wood chip-board of high density having a thickness of 1.8 cm and four generally square lands 14 cut from a sheet of wood chip-board of regular density having a thickness of 2.5 cm.

The four lands 14 are secured to the underside of the panel 12 in the four corners to define therebetween a cruciform void constituting two intersecting channels 15 and 16 each having a width of 7 cm and extending between opposed edges of the slab 10. These channels of course form a lattice of intersecting cable-carrying ducts 20 when the slabs 10 are laid in position on the substrate 11.

The innermost corners 30 of the lands 14 are radiused or bevelled to ensure that no cable threaded or pulled through the ducts 20 will be subjected to an unacceptable degree of bending.

The corners 40 of the lands 14 on either side of each channel where it exits the slab 10 are also radiused to ensure that any slight misalignment of channel axes in manufacture or installation will not prevent easy passage of a fishing tool, sometimes called a mouse, across the junction between adjacent slabs 10.

A thin layer 50 of resiliently compressible material such as a neoprene foam, for example, is located between the panel 12 and lands 14. This enables the slabs 10 to accommodate slight irregularities in the level of the substrate 11, and provides a cushioning effect reducing noise as persons walk over the floor.

Small protrusions 60 into the channels and level with the underside of the lands 14 are provided to prevent any cable being pulled through a duct 20 from lifting a slab 10 and locating itself beneath a land 14.

In use special slabs 10, provided with service sockets can be positioned where required and connected with cabling in the ducts 20, to provide required services to desired workstations. They can be moved and replaced as need or desire dictates. Indeed, this access floor can be moved as a whole when moving offices or from one part of a building to another.

It will be appreciated that it is not intended to limit the invention to the above example only, many variations, such as might readily occur to one skilled in the art, being possible, without departing from the scope thereof.

For example, there may be a plurality of parallel channels extending in one or both directions on the underside of the slab.

The chip-board from which the slabs are made may be specially formulated to include desired additives such as anti-static agents for example. If necessary in certain environments the top panels may be laminated with veneers of metal or other material to improve hygrothermal performance.

Instead of fabricating the slabs from a plurality of separate pieces, they may be formed as an integral one-piece moulding of suitable material such as a mixture of wood fibre and thermosetting resin. Equally the slabs may be formed as monolithic castings of a suitable cementitious material such as aerated concrete for example. In these latter cases a layer of resilient compressible material 70 may be adhered to the underside of the lands between the channels if required or such may be spread over the floor substrate before laying the slabs.

Loose bridge-like units may be provided for positioning under the slabs at the intersections of the ducts to provide for some separation between crossing cables.

I claim:

1. An access floor comprising solid slabs laid in abutting relationship on an underlying floor surface, each slab comprising a solid top having a plurality of underside corner portions and opposing edges and a land member secured to each of said underside corner portions of said solid top so as to form a cruciform void having two crossing channels extending between said opposing edges of the slab, said channels of adjacent slabs aligning to form a lattice of intersecting extended cable and like service-receiving ducts, the slabs being laid directly on to said floor surface and without necessarily removing any floor covering thereon, said slabs being of solid and high density material whereby to remain in position without requiring any connection means to adjacent slabs, wherein said channels of each of said lands intersect with each other, and a layer of resiliently compressible material located between each of said lands and said solid top and at least one protrusion extending into said channels and extending from a bottom portion of said lands.

2. A floor according to claim 1, which comprises a carpet tile layer positioned on a top surface of said solid top.

3. An access floor comprising solid slabs laid in abutting relationship on an underlying floor surface, each slab comprising a solid top having a plurality of underside corner portions and opposing edges and a land member secured to each of said underside corner portions of said solid top as to form a cruciform void having two crossing channels extending between said opposing edges of the slab, said channels of adjacent slabs aligning to form a lattice of intersecting extended cable and like service-receiving ducts, the slabs being laid directly on to said floor surface and without necessarily removing any floor covering thereon, said slabs being of a solid and high density material whereby to remain in position without requiring any connection means to adjacent slabs, wherein said channels of each of said lands intersect with each other, and a layer of resiliently compressible material located between each of said lands and said solid top and a carpeting tile layer positioned on a top surface of said solid top, and a plurality of protrusions extending into said channels and level with an underside portion of the slab.

* * * * *